US008632233B2

(12) United States Patent
Kawamura

(10) Patent No.: US 8,632,233 B2
(45) Date of Patent: Jan. 21, 2014

(54) VEHICLE LIGHTING DEVICE WITH HEAT SINK MEMBER AND SHADE

(75) Inventor: Takayuki Kawamura, Isehara (JP)

(73) Assignee: Ichikoh Industries, Ltd., Isehara-shi (JP)

( * ) Notice: Subject to any disclaimer, the term of this patent is extended or adjusted under 35 U.S.C. 154(b) by 195 days.

(21) Appl. No.: 13/034,108

(22) Filed: Feb. 24, 2011

(65) Prior Publication Data

US 2011/0211361 A1 Sep. 1, 2011

(30) Foreign Application Priority Data

Mar. 1, 2010 (JP) ..... 2010-043894

(51) Int. Cl.
*F21V 11/00* (2006.01)

(52) U.S. Cl.
USPC ..... 362/539; 362/547; 362/545; 362/517

(58) Field of Classification Search
USPC ..... 362/516–517, 539, 519, 298–300, 362/544–545, 547
See application file for complete search history.

(56) References Cited

U.S. PATENT DOCUMENTS

| | | | | |
|---|---|---|---|---|
| 6,494,603 | B1 | 12/2002 | Takada | |
| 7,866,863 | B2 | 1/2011 | Tanaka | |
| 7,918,595 | B2 * | 4/2011 | Albou | 362/518 |
| 7,963,684 | B2 | 6/2011 | Stauss et al. | |
| 2008/0170408 | A1 | 7/2008 | Tanaka | |
| 2009/0097269 | A1 | 4/2009 | Stauss et al. | |
| 2009/0284980 | A1 * | 11/2009 | Iwasaki | 362/517 |

FOREIGN PATENT DOCUMENTS

| | | | |
|---|---|---|---|
| DE | 10 2007 049 309 | A1 | 4/2009 |
| EP | 1 772 666 | A1 | 4/2007 |
| EP | 2 112 429 | B1 | 10/2009 |
| JP | 2001-035218 | A | 2/2001 |
| JP | 2005-302603 | A | 10/2005 |
| JP | 2008-041557 | A | 2/2008 |
| JP | 2008-060030 | A | 3/2008 |
| JP | 2008-171743 | A | 7/2008 |
| JP | 2009-259667 | A | 7/2008 |
| JP | 2010-287396 | A | 12/2010 |

* cited by examiner

*Primary Examiner* — Robert May
(74) *Attorney, Agent, or Firm* — Foley & Lardner LLP

(57) ABSTRACT

A vehicle lighting device is provided which is capable of merely changing a shade, thereby using a first reflector and a second reflector as they are, to cope with a variety of light distribution pattern specifications, and which is capable of avoiding deformation of a shade due to a thermal effect even if incidence of sunlight going back has optically focused on the shade. In a heat sink member 40, there are arranged: a semiconductor-type light source 10; a first reflector 21 covering the semiconductor-type light source 10 therewith; a second reflector 22 for causing the reflected light from the first reflector 21 so as to be made incident thereto and then reflecting the incident light forward of the lighting device; and a shade 30 for shading a part of the reflected light from the first reflector 21 so as to be made incident to the second reflector 22. The shade 30 is configured as another member independent of the first and second reflectors 21, 22, and is arranged in the heat sink 40.

5 Claims, 2 Drawing Sheets

VEHICLE LIGHTING DEVICE WITH HEAT SINK MEMBER AND SHADE

CROSS REFERENCE TO RELATED APPLICATIONS

This application claims priority of Japanese Patent Application No. 2010-043894 filed on Mar. 1, 2010. The contents of this application are incorporated herein by reference in their entirety.

BACKGROUND OF THE INVENTION

1. Field of the Invention

The present invention relates to a vehicle lighting device employed for a headlamp or a rear combination lamp of a vehicle.

2. Description of the Related Art

In recent years, a self-light emitting semiconductor-type light source such as a light emitting diode has been employed as a light source for vehicle lighting device, such as a headlamp.

Such a semiconductor-type light source configures a light source unit together with a reflector for reflecting light therefrom forward of a lighting device and is arranged in a lamp room which is made up of a housing and an outer lens.

The semiconductor-type light source that is employed as a light source for vehicle lighting device has been developed to achieve high intensity of illumination in order to enhance an effect of illumination. With a need for such achievement of high intensity of illumination, a heat rate increases as well. As a measure for mitigating a temperature rise of this semiconductor-type light source, it has been a routine practice to intensively arrange the semiconductor-type light source and the reflector while this heat sink member is used as a base.

On the other hand, in general, a reflector is die-molded with a thermoplastic synthetic resin material with its good moldability for the sake of forming a reflection surface having its complicated curved face.

In a lighting device employing such a synthetic resin-based reflector, for example, as disclosed in Japanese Patent Application Laid-open No. 2008-41557, it is known that the lighting device is provided with: a first reflector which is arranged to cover the periphery of a semiconductor-type light source fixed to a heat sink member, for reflecting light emitted from the semiconductor-type light source so as to be oriented in a predetermined direction; and a second reflector for causing the reflected light from the first reflector to be incident thereto and then reflecting the incident light so as to be oriented forward of the lighting device.

The first reflector and the second reflector are integrally molded with each other and a shade is also integrally formed at a communication portion between these reflectors. In this manner, a part of the reflected light from the first reflector is shaded with the shade so that a predetermined light distribution pattern can be obtained.

While a light distribution pattern is determined depending on an edge shape of a shade, the shade is integrally formed with the first reflector and the second reflector as described previously. Therefore, plural types of reflectors having their different edge shapes of the shade must be provided in order to cope with specifications of a variety of countries, which is disadvantageous in terms of cost efficiency.

In addition, in a case where a vehicle is stopped on slope daytime, if sunlight is caused to be incident to the second reflector from the front side of the vehicle, the sunlight that is reflected by the second reflector goes along a path in an opposite direction to that of an optical path forming a light distribution and optically focuses on the shade. Thus, the shade is deformed by being subjected to a thermal effect of such solar light and such deformation can adversely affect light distribution performance.

Therefore, the present invention provides a vehicle lighting device which is capable of causing a shade to maintain compatibility to cope with specifications of a variety of countries and is capable of avoiding lowering of the light distribution performance due to the thermal effect of the shade even if incidence of sunlight going back from a light distribution path takes place.

SUMMARY OF THE INVENTION

A vehicle lighting device, comprising:

a semiconductor-type light source;

a first reflector covering the semiconductor-type light source therewith, for reflecting light emitted from the semiconductor-type light source so as to be oriented in a predetermined direction;

a second reflector for causing the reflected light from the first reflector to be incident thereto and then reflecting the incident light so as to be oriented forward of the lighting device;

a shade for shading a part of the reflected light from the first reflector and then causing a remaining part thereof to be incident to the second reflector; and a heat sink member in which the semiconductor-type light source, the first reflector, the second reflector, and the shade are intensively arranged, wherein the shade being configured as another member independent of the first reflector and the second reflector, the shade being arranged in the heat sink member.

According to the present invention, a shade is configured as another member independent of a first reflector and a second reflector. Therefore, by employing a shade formed in an edge shape in which a required light distribution pattern can be obtained, the first reflector and the second reflector are commonly used to be able to configure a vehicle lighting device which is caused to maintain compatibility to cope with light distribution patterns that conform to a variety of specifications, thus enabling cost reduction.

In addition, while the first reflector and the second reflector each are made of a thermoplastic synthetic resin with its good moldability, the shade can be formed of a material having its good heat resistance and heat dissipation. Therefore, even if incidence of sunlight going back from a light distribution path optically focuses on the shade, it becomes possible to avoid deformation of the shade due to a thermal effect of such sunlight and to prevent lowering of light distribution performance.

DESCRIPTION OF THE PREFERRED EMBODIMENTS

Hereinafter, an embodiment of the present invention will be described with reference to the drawings by way of example of a vehicle headlamp.

Figure 1:
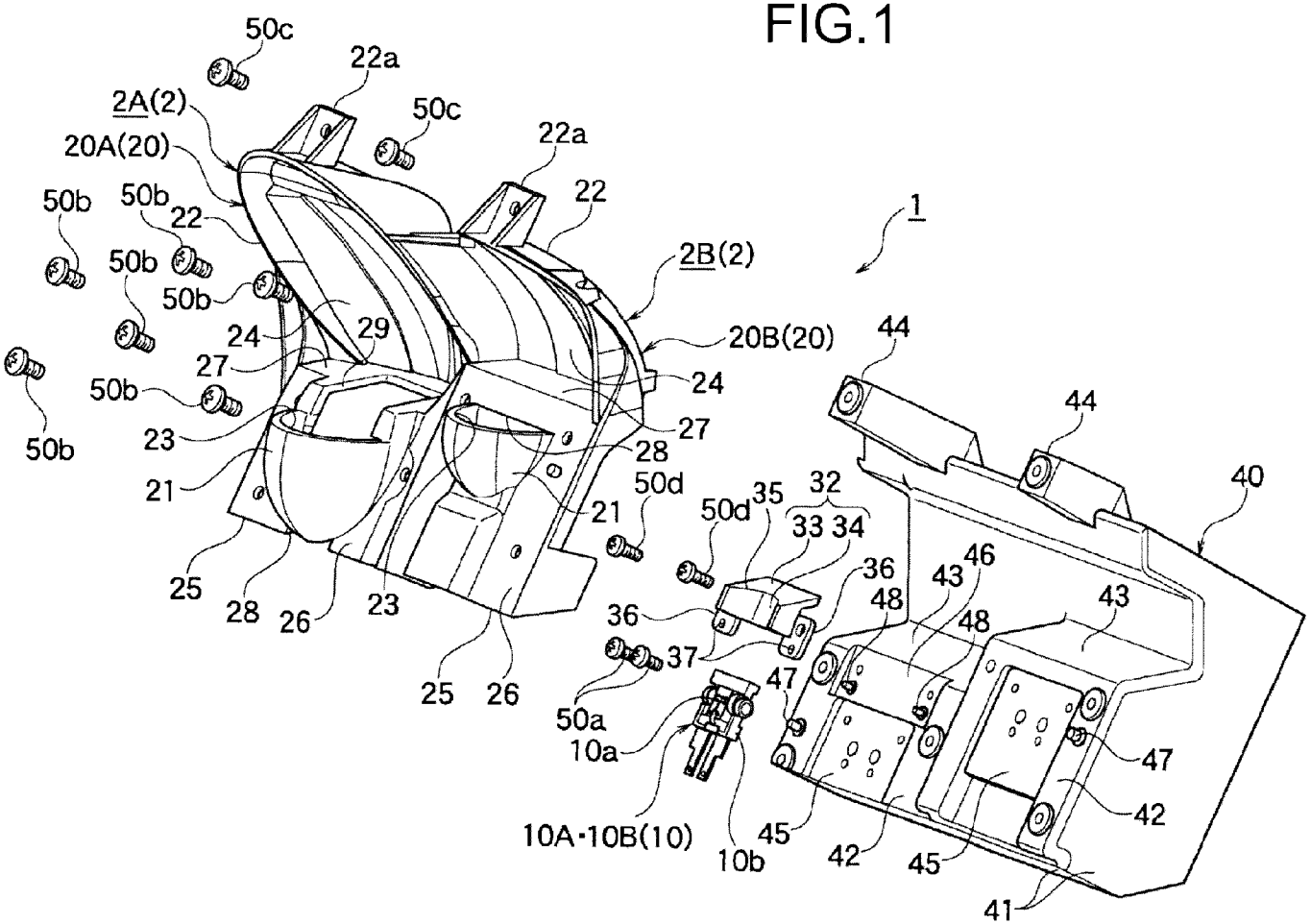
FIG. 1 is a disassembled perspective view showing a lighting device unit of a headlamp according to an embodiment of the present invention.
Figure 2:
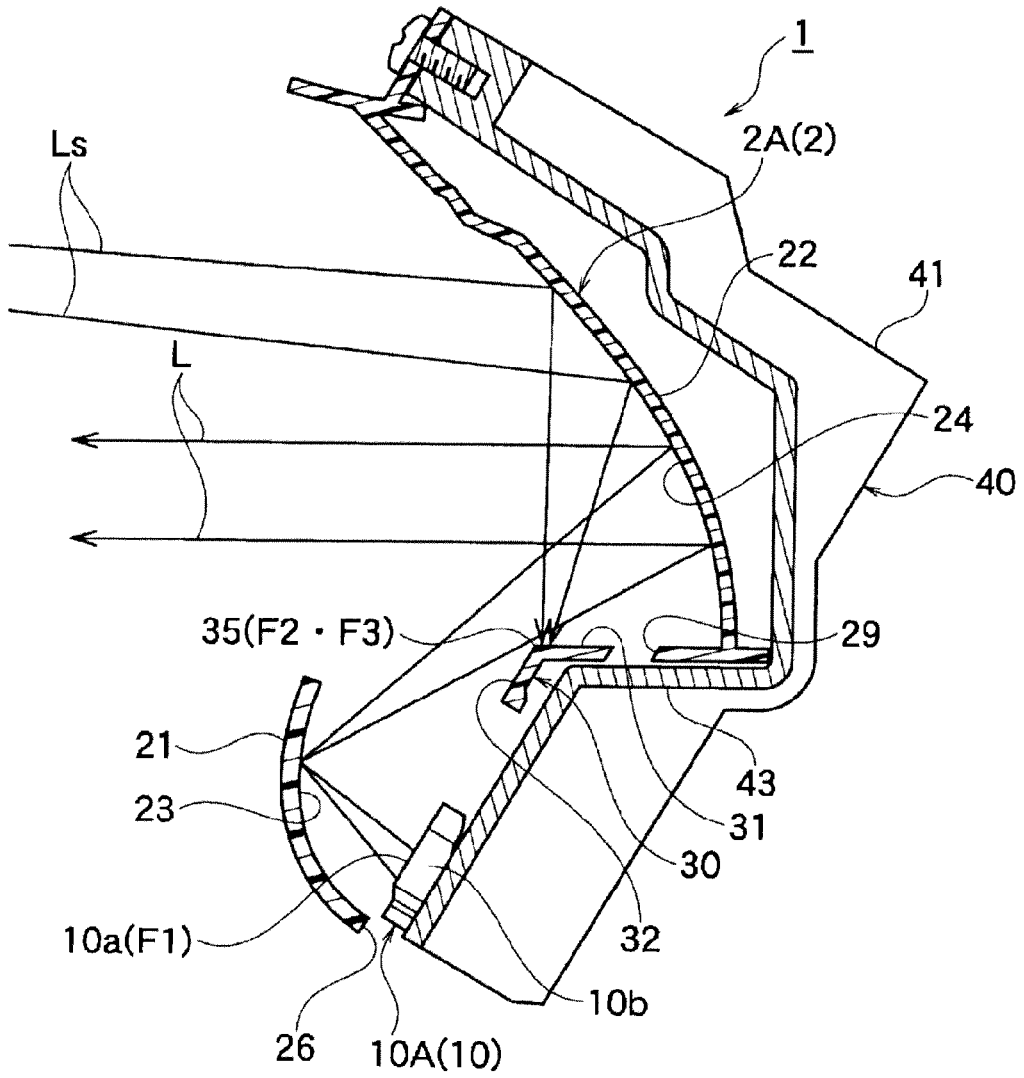
FIG. 2 is a sectional explanatory view of the lighting device unit shown in FIG. 1.

The headlamp of the present embodiment, shown in FIG. 1 and FIG. 2, is provided with a semiconductor-type light source 10, a reflector 20, and a heat sink member 40.

The semiconductor-type light source 10, the reflector 20, and the heat sink member 40 configure a lighting device unit 1 and the lighting device unit 1 is arranged in a lamp room which is made up of a housing and an outer lens, although not shown, whereby a headlamp is configured.

In the present embodiment, this headlamp is provided with: two semiconductor-type light sources 10A, 10B and two reflectors 20A, 20B that correspond to these semiconductor-type light sources 10A, 10B. A set of the semiconductor-type light source 10A and the reflector 20A and a set of the semiconductor-type light source 10B and the reflector 20B each are configured as one set of light source units 2, and these two sets 2A and 2B are provided together in a transverse direction (a vehicle widthwise direction) on a front face of one heat sink member 40.

The reflectors 20A, 20B are integrally molded with each other by means of a die, with an optically opaque thermoplastic synthetic resin material. These reflectors 20A, 20B are provided with a first reflector 21 and a second reflector 22, respectively.

The first reflector 21 is integrally molded at an oblique flat plate portion 26 of a reflector base 25 and the second reflector 22 is integrally molded to be erected from a rear end of a horizontal flat plate portion 27 which communicates with an upper end of this oblique flat plate portion 26.

An opening portion 28 for disposing the semiconductor-type light source 10 is formed in the oblique flat plate portion 26 and the first reflector 21 is formed so as to thereby surround this opening portion 28.

On the side of the reflector 20A, an arrangement port 29 of a shade 30 to be described later, which communicates with the opening portion 28, is formed. This shade arrangement port 29 is formed from an upper part of the oblique flat plate portion 26 over a substantial halve of the horizontal flat plate portion 27.

The first reflector 21 has a concave reflection surface 23 which is disposed to cover the front side of the lighting device of the semiconductor-type light source 10 therewith, for reflecting the light emitted from the semiconductor-type light source 10 so as to be oriented obliquely upward in a backward direction.

The second reflector 22 has a concave reflection surface 24 for causing the reflected light from the first reflector 21 to be incident thereto and then reflecting the incident light so as to be oriented forward of the lighting device.

The reflection surfaces 23, 24 each are formed by applying aluminum vapor deposition or silver coating to an reflector interior of the reflector.

The reflection surface 23 of the first reflector 21 is made of an elliptical or ellipse-based curved face, for example, a rotational elliptical face or an ellipse-based free curved face.

This first reflector 21, as shown in FIG. 2, has a first focal point F1 and a second focal point F2, and the light that is emitted from the first focal point F1 is reflected on the reflection surface 23 and then the reflected light optically focuses on the second focal point F2.

A light emitting portion 10*a* of the semiconductor-type light source 10, is disposed at or near the first focal point F 1 of the first reflector 21. In this manner, the light that is reflected by means of the reflection surface 23 of the first reflector 21, of the light emitted from the semiconductor-type light source 10, is optically focused at or near the second focal point F2 of the first reflector 21.

A reflection surface 24 of the second reflector 22 is formed on a parabola-based free curved face, and has a focal point F3, as shown in FIG. 2. This focal point F3 is positioned at the second focal point F2 of the first reflector 21. In this manner, if the light that is reflected on the reflection surface 23 of the first reflector 21 and then is optically focused on the second focal point F2 is caused to be incident to the reflection surface 24 of the second reflector 22, the incident light is reflected as parallel light L by means of the reflection surface 24 so as to be oriented forward of the lighting device.

The semiconductor-type light source 10 is a light source utilizing luminescence (a light emitting phenomenon) which is obtained by applying a voltage to a semiconductor, such as electroluminescence (EL) including a light emitting diode (an LED), an organic EL, and an inorganic EL.

The heat sink member 40 is formed of a metal material having its good thermal conductivity, for example, an aluminum die cast. On a rear face of this heat sink member, a plurality of longitudinally formed heat dissipation fins 41 are disposed to be provided in array appropriately at equal intervals in a transverse direction (a vehicle widthwise direction).

This heat sink member 40 also serves as a base for intensively disposing the semiconductor-type light source 10, the first reflector 21, and the second reflector 22 or the like based on an optical design, and is adapted to dissipate a heat generated at the semiconductor-type light source 10. The heat sink member 40 corresponds to a shape of the reflector 20. A front face of this heat sink member is formed as a first reflector mount face 42 which is flat and is tilted obliquely upward in association with the oblique flat face portion 26 of the reflector 20. A horizontal rack portion 43 which corresponds to the horizontal plat plate portion 27 of the reflector 20 is formed in communication with an upper end of the heat sink member 40. In addition, one pair of second reflector mount bases 44 on the left and right sides, which overhang forward of the lighting device, are molded in a protrusive manner at an upper end of the heat sink member 40.

A light source mount face 45 for mounting the semiconductor-type light source 10 is molded in a stepped manner in which the mount face becomes lower by one step at a central portion of the first reflector mount face 42.

The semiconductor-type light source 10 is mounted by superimposing a substrate 10*b* on the light source mount face 45 and then securely tightening and fixing the light emitting portion 10*a* by means of a screw member 50*a* forward of the lighting device. This securely tightening and fixing activity is performed in a state in which the substrate 10*b* is precisely positioned by means of a locating pin, although not shown.

The reflector 20 is then securely tightened and fixed to the heat sink member 40 in a state in which the front side of the lighting device of the semiconductor-type light source 10 is covered with the first reflector 21.

In other words, the horizontal flat plate portion 27 of the reflector 20 is engaged on the rack portion 43 of the heat sink member 40; and the oblique flat plate portion 26 is superimposed on the first reflector mount face 42 that corresponds thereto and then is securely tightened and fixed to the first reflector mount face 42 by means of a screw member 50*b*. At this time, the oblique flat plate portion 26 is positioned by means of a locating pin 47 and then precise positioning of the first reflector 21 relative to the semiconductor-type light source 10 is performed. The second reflector 22 is then securely tightened and fixed by means of a screw member 50*c* in a state in which a bracket 22*a* that is integrally molded at an upper end part of the second reflector is abutted against the second reflector mount base 44.

As described previously, in the present embodiment, two sets of semiconductor units 2A, 2B, which are made up of a set of the semiconductor-type light source 10A and a set of the reflector 20A and the semiconductor light source 10B and the reflector 20B, are provided together in their transverse direction with one heat sink member 40 being employed as a base, whereas the shade 30 is arranged at one light source unit 2A.

The shade 30 is adapted to shade a part of the light emitted from the semiconductor-type light source 10A and then form a cutoff line of a predetermined shape at an upper edge of a light distribution pattern.

In other words, one light source unit 2A is configured as a light source unit for forming a low beam (a passing beam) of which: a cutoff line of a predetermined shape is formed at an upper edge of a light distribution pattern by means of the shade 30; and the other light source unit 2B is configured as a light source unit for forming a high beam (a running beam) without the shade 30.

The second reflector 22 of the light source unit 2B for forming a high beam is funned in a shape which is smaller than the second reflector 22 of the light source unit 2A for forming a low beam by one turn.

In addition, a lower edge position of the semiconductor-type light source 10B of the light source unit 2B for forming a high beam and the reflection surface 24 of the first reflector 21 or the second reflector 22 (a crossing point associated with the horizontal flat plate portion 27) is set to be displaced upward and forward based on a predetermined optical design with respect to each of the corresponding portions (10A, 21, 24) of the light source unit 2A for forming a low beam so that a predetermined diffusion light distribution pattern can be obtained.

Therefore, in the heat sink member 40, the first reflector mount face 42, the light source mount face 45, or the rack portion 43 on which the light source unit 2B for forming a high beam is arranged is set to be displaced upward and forward with respect to each of the corresponding portions (42, 45, 43) on which the light source unit 2A for forming a low beam is arranged.

The shade 30 is configured as another member independent of the first reflector 21 and the second reflector 22 that configure the reflector 20. This shade is also arranged in the hat sink member 40.

The shade 30 is formed of a metal material having its good heat resistance, for example, an aluminum die cast having its good heat resistance and heat dissipation, as is the case with the heat sink member 40.

This shade 30 is formed in a substantial V-shape on a side face, one side of which is configured as a positioning portion 31 which extends in a horizontal direction and is engagingly locked onto the rack portion 43 of the heat sink member 40 and the other side of which is configured as a fixing portion 32 which is fixed to a front face portion which communicates with the rack portion 43 of the heat sink member 40.

A fixing portion 32 is provided with: a light shading face 33 which is formed at a middle portion; and a bracket 34 which is formed at each end part of the light shading face 33.

The light shading face 33 is formed as an irregular face corresponding to a cutoff line of a predetermined shape of a light distribution pattern that is formed on a virtual screen at the front side of the lighting device. A communication portion between the light shading face 33 made of the irregular face and the positioning portion 31 is configured as an edge 35 for forming a cutoff line of a predetermined shape on an upper edge of the light distribution pattern.

The light shading face 33 and the bracket 34 are formed at a front face portion of the heat sink member 40, specifically at a tilt angle which is the same as that of the shade mount face 46 that is provided in communication with an upper portion of the light source mount face 45 in the first reflector mount face 42.

The left and right brackets 34 each have one screw hole 36 and one locating hole 37.

In addition, this shade 30 is directly securely tightened and fixed to the heat sink member 40 by inserting a screw member 50*d* through the screw hole 36 in a state in which: the positioning portion 31 is temporarily positioned after being engagingly locked onto the rack portion 43 of the heat sink member 40 through a shade arrangement port 29 of the reflector 20A; and the locating pin 48 that is provided on the shade mount face 46 is precisely positioned after being inserted through the locating hole 37 of the bracket 34. At this time, an edge 35 of the shade 30 is set so as to substantially coincide with a position of the second focal point F2 of the first reflector 21.

In this manner, the lamp unit 1 that is configured in such a manner that two sets of light source units 2A, 2B are transversely provided together, with one heat sink member 40 being employed as a base, is assembled to enable optical axis adjustment in the lamp room by means of an optical axis adjustment mechanism, although not shown, the adjustment mechanism having an adjustment bolt and a pivot that are provided across the heat sink member 40 and a housing, although not shown.

In the headlamp of the present embodiment, which is made of the above constituent elements, the shade 3 is configured as another member independent of the first reflector 21 and the second reflector 22 that configure the reflector 20A. Therefore, by employing a shade 30 of an edge shape in which a required light distribution pattern can be obtained, it becomes possible to configure a headlamp which maintains compatibility to cope with light distribution patterns of a variety of countries, such as Japan, Europe, or North American, with the first reflector 21 and the second reflector 22 being commonly used as they are, thus enabling cost reduction.

In addition, the shade 30 is formed in a substantial V-shape on a side face; the positioning portion 31 that extends in a horizontal direction of one side of the shade is engagingly locked onto the rack portion 43 of the heat sink member 40; and the fixing portion 32 of the other side is superimposed on, and is fixed to, the shade mount face 46 of the front face portion that communicates with the rack portion 43. In this manner, the shade 30 can be directly mounted with the heat sink member 40 being employed as a reference face, together with the semiconductor-type light source 10A, the first reflector 21, and the second reflector 22 with the heat sink member 40 being employed as a reference mount face. Therefore, lowering of light distribution performance can be avoided while positional precision between these optical members is ensured.

In addition, a communication portion between the positioning portion 31 and the fixing portion 32 of this shade 30 is configured as an edge 35 for forming a cutoff line of a predetermined shape at an upper edge of a light distribution pattern, thus easily enabling shape definition and molding of the edge 35.

Further, the first reflector 21 and the second reflector 22 are made of a thermoplastic synthetic resin with its good moldability so that their reflection surfaces 23, 24 can be precisely molded, whereas the shade 30 is made of an aluminum die cast having its good heat resistance and heat dissipation. Therefore, like when a vehicle is stopped on slope daytime, even in a case where sunlight LS is caused to be incident to a headlamp while going back from its light distribution path and then the incident sunlight optically focuses on the shade 30 (see FIG. 2), lowering of light distribution performance can be prevented while deformation of the shade 30 due to a thermal effect of sunlight is avoided.

Moreover, the first reflector 21 and the second reflector 22 are integrally formed in a shape in which the shade arrangement port 29 is opened, so that light distribution performance can be enhanced more significantly without causing a displacement in optical position relationship between these reflection surfaces 23 and 24.

While the foregoing embodiment has described a vehicle headlamp by way of example, the present invention can also be applied to a rear combination lamp. In addition, while the shade 30 is made of an aluminum die cast, this shade can also be made of a good thermosetting resin as long as it can function properly.

What is claimed is:

1. A vehicle lighting device, comprising:

a semiconductor-type light source;

a first reflector covering the semiconductor-type light source therewith, for reflecting light emitted from the semiconductor-type light source so as to be oriented in a predetermined direction;

a second reflector for causing the reflected light from the first reflector to be incident thereto and then reflecting the incident light so as to be oriented forward of the lighting device;

a shade for shading a part of the reflected light from the first reflector and then causing a remaining part thereof to be incident to the second reflector; and a heat sink member in which the semiconductor-type light source, the first reflector, the second reflector, and the shade are arranged, wherein the shade being configured as another member independent of the first reflector and the second reflector, the shade formed in an edge shape in which a required light distribution pattern can be obtained, the shade being arranged in the heat sink member, the shade being formed of a shade material being a heat resistant and heat dissipative metal, and being mounted to the heat sink member; and the first reflector and the second reflector being integrally molded with each other and being of a synthetic resin material.

2. The vehicle lighting device according to claim 1, wherein the shade is formed in a substantial V-shape on a side face, one side of which is configured as a positioning portion which extends in a horizontal direction and is engagingly locked onto a rack portion of the heat sink member and the other side of which is configured as a fixing portion which is fixed to a front face portion communicating with the rack portion of the heat sink member.

3. The vehicle lighting device according to claim 2, wherein a communication portion between the positioning portion and the fixing portion of the shade is configured as an edge for forming a cutoff line of a predetermined shape at an upper edge of a light distribution pattern formed forward of the lighting device.

4. The vehicle lighting device according to claim 1, wherein:

the first reflector and the second reflector being in a shape in which a shade arrangement port is opened, the shade arrangement port is for mounting the shade against the heat sink member.

5. A vehicle lighting device, comprising:

a semiconductor-type light source;

a first reflector covering the semiconductor-type light source therewith, for reflecting light emitted from the semiconductor-type light source so as to be oriented in a predetermined direction;

a second reflector for causing the reflected light from the first reflector to be incident thereto and then reflecting the incident light so as to be oriented forward of the lighting device;

a shade for shading a part of the reflected light from the first reflector and then causing a remaining part thereof to be incident to the second reflector; and a heat sink member in which the semiconductor-type light source, the first reflector, the second reflector, and the shade are arranged, wherein the shade being configured as another member independent of the first reflector and the second reflector, the shade being arranged in the heat sink member, the shade is formed in a substantial V-shape on a side face, one side of which is configured as a positioning portion which extends in a horizontal direction and is engagingly locked onto a rack portion of the heat sink member and the other side of which is configured as a fixing portion which is fixed to a front face portion communicating with the rack portion of the heat sink member, and a communication portion between the positioning portion and the fixing portion of the shade is configured as an edge for forming a cutoff line of a predetermined shape at an upper edge of a light distribution pattern formed forward of the lighting device, the shade being formed of a shade material being a heat resistant and heat dissipative metal, and being mounted to the heat sink member; and the first reflector and the second reflector being integrally molded with each other and being of a synthetic resin material.

* * * * *